US008307581B2

(12) United States Patent
Badgley et al.

(10) Patent No.: US 8,307,581 B2
(45) Date of Patent: Nov. 13, 2012

(54) DISPOSABLE-GERM-FREE GUARD FOR A DOOR OR DOOR HANDLE

(75) Inventors: Robert J. Badgley, Orange, CA (US); Roger A. Roberts, Orange, CA (US)

(73) Assignee: Morgan Madison, Inc., Orange, CA (US)

( * ) Notice: Subject to any disclaimer, the term of this patent is extended or adjusted under 35 U.S.C. 154(b) by 336 days.

(21) Appl. No.: 12/584,303

(22) Filed: Sep. 4, 2009

(65) Prior Publication Data

US 2010/0281781 A1 Nov. 11, 2010

Related U.S. Application Data

(60) Provisional application No. 61/215,345, filed on May 5, 2009.

(51) Int. Cl.
*E06B 7/00* (2006.01)

(52) U.S. Cl. ..... 49/70; 49/460

(58) Field of Classification Search ..... 49/70, 460; 16/904; 134/104.1, 115 R
See application file for complete search history.

(56) References Cited

U.S. PATENT DOCUMENTS 4,677,697 A * 7/1987 Hayes ..... 2/159
5,025,503 A * 6/1991 O'Brien ..... 2/163
5,799,331 A * 9/1998 Stewart ..... 2/159
5,975,083 A * 11/1999 Henderson, Jr. ..... 128/878
6,385,817 B1 * 5/2002 Johnson ..... 16/431
6,645,435 B2 * 11/2003 Dawson et al. ..... 422/110
6,868,999 B1 * 3/2005 Gochanour ..... 225/90
6,912,728 B2 * 7/2005 Panella ..... 2/16
7,716,789 B1 * 5/2010 Zevallos ..... 16/412
7,757,351 B2 * 7/2010 Davis, Jr. ..... 16/412
7,850,114 B2 * 12/2010 Lavy ..... 242/538

* cited by examiner

*Primary Examiner* — Jerry Redman
(74) *Attorney, Agent, or Firm* — Morland C. Fischer

(57) ABSTRACT

A guard to prevent direct touch contact between an individual's hand and a handle or a contact surface of a door to which a pushing or pulling force is applied to cause the door to open. According to a first preferred embodiment, a hollow cylindrical core is moved into removable surrounding engagement with a door handle. A plurality of protective strips are laid one above the other in a roll that surrounds the core. According to another preferred embodiment, a plurality of protective strips or coverings are disposed one above the other in a stack that is attached over a pushing surface of the door. Successive ones of the plurality of strips and coverings can be removed from the roll or stack and discarded following use. One surface of each of the strips and coverings is treated with a layer which includes a mixture of adhesive and microbicide. The layer of adhesive and microbicide enables the plurality of strips and coverings to be adhesively bonded to one another while discouraging the growth and spread of potentially disease-causing bacteria.

6 Claims, 3 Drawing Sheets

DISPOSABLE-GERM-FREE GUARD FOR A DOOR OR DOOR HANDLE

CROSS-REFERENCE TO RELATED APPLICATIONS

This application is related to Provisional Application No. 61/215,345 filed May 5, 2009.

BACKGROUND OF THE INVENTION

1. Field of the Invention

This invention relates to a disposable protective guard to prevent direct touch-contact between an individual's hand and a hand-contact surface. By way of a preferred embodiment, the protective guard, which is treated with a microbicide to discourage the growth and spread of potentially disease-causing bacteria, is removably attached to either a handle or a pushing surface of a door.

2. Background Art

It is known that germs, viruses and similar potentially health-threatening bacteria are found on a variety of hand-contact surfaces such as, for example, handles and pushing surfaces associated with a door. Many viral infections remain untreatable, and the availability of effective antiviral drugs and vaccines is somewhat limited. One manner to limit the transmission of viral infections and disease is for individuals to frequently wash their hands. However, hand washing facilities are not always readily available throughout an individual's day. Another means to reduce the spread of disease is to apply a cover to prevent one's hands from coming into direct contact with surfaces which are frequently touched by different individuals and on which surfaces such disease-causing micro-organisms typically lie. However, the conventional (i.e., handle) coverings themselves are not adapted to prevent the growth and spread of potentially disease-causing bacteria caused by frequent touching. Therefore, the coverings must be replaced and discarded following each use which increases both the cost and inconvenience. Otherwise, the coverings may be largely ineffective to safeguard subsequent users who touch the coverings throughout the day. The ability to prevent the spread of disease among different workers who touch a contact surface is particularly acute in hospitals and other healthcare facilities where patients' medical well-being is at stake.

Accordingly, it would be desirable to have a reliable disposable protective guard to be removably attached to a hand-contact surface, such as a door handle, a pushing surface of a door, and the like, to prevent direct contact between an individual's hands and the contact surface and to reduce the growth and spread of potentially disease-causing bacteria from one individual's hand to the next.

SUMMARY OF THE INVENTION

This invention relates to disposable protective guards to prevent direct touch contact between an individual's hand and a contact surface such as, for example, a door handle or a pushing surface of a door. According to a first preferred embodiment, the protective guard is capable of being positioned in surrounding engagement with a door handle. The protective door handle guard includes a hollow cylindrical core that is preferably treated with a disinfectant. A slit extends longitudinally through the core. A plurality of peel-off protective strips are laid one above the other in a roll around the core. The protective strips are sized so as not to cover the slit through the core. The door handle guard is removably attached to the door handle when the handle is received at the hollow interior of the core via the longitudinal slit formed therethrough. Each strip from the roll of peel-off protective strips around the core has an untreated top which is initially germ free. The bottom of each strip is treated (e.g., coated) with a dual-function layer containing an adhesive into which a microbicide is mixed to create a tacky/sticky surface. The adhesive from the dual-function layer causes the bottom of one strip from the roll to be bonded to and cover the top of an adjacent strip lying thereunder to preserve its initial germ-free condition. At the same time, some of the microbicide that is mixed into the adhesive is transferred on contact along with the adhesive from the bottom of one strip to the top of the adjacent strip underneath. Thus, the top of each strip to be grasped by the hand of an individual is covered with a germ-resisting microbicide to prevent the growth and spread of potentially disease-causing bacteria. The topmost strip may be removed from the roll at a pull tab thereof as is necessary throughout the day and replaced by the next strip.

According to another preferred embodiment, the contact surface to which the disposable protective guard is attached is a push plate mounted on a door to which a pushing force is manually applied. A plurality of peel-off protective strips are laid one above the other to form a stack. The stack of protective strips is bonded to the door so as to cover the push plate thereof. Like the protective strip described above, each strip from the stack of strips attached to the push plate has an untreated top which is initially germ free. The bottom of each strip is treated (e.g., coated) with a dual-function layer containing an adhesive into which a microbicide is mixed to create a tacky/sticky touch surface. The adhesive from the dual-function layer causes the bottom of one strip from the stack to be bonded to and cover the top of an adjacent strip lying thereunder to preserve its initial germ-free condition. At the same time, some of the microbicide that is mixed into the adhesive is transferred on contact along with the adhesive from the bottom of one strip to the top of the adjacent strip underneath. Thus, the top of each strip to which a pushing force is applied by the hand of an individual is covered with a germ-resistance microbicide to prevent the growth and spread of potentially disease-causing bacteria. The topmost strip may be removed from the stack at a pull tab thereof as is necessary throughout the day and replaced by the next strip.

DESCRIPTION OF THE PREFERRED EMBODIMENT

Referring concurrently to FIGS. 1-5 of the drawings, a disposable handle guard 1 according to a first preferred embodiment of this invention is disclosed. The handle guard 1 has particular application to cover a handle which is grasped in the hand of an individual to open a door so as to prevent the spread of disease-causing bacteria among those whose hands touch the handle throughout the day. The handle guard 1 creates a germ-reducing barrier to prevent direct touch contact between an individual's hand and the handle. What is more, by virtue of its disposable nature, the handle guard 1 can be easily and conveniently removed throughout the day and replaced with a fresh handle guard which offers a new germ-reducing contact surface to grasp. The handle guard 1 herein disclosed is ideally suited for use on handles of doors that are found in health care facilities (e.g., hospitals) where maintaining a germ-free environment is vital to the medical well-being of patients.

Figure 1:
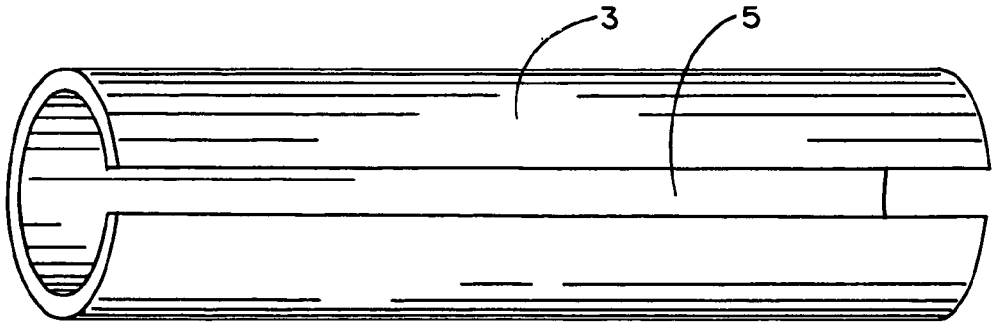
FIG. 1 shows a hollow core from a disposable door handle guard according to a first preferred embodiment of this invention.

The handle guard 1 includes a hollow cylindrical core 3 (best shown in FIG. 1). The core 3 is preferably manufactured from a flexible material, such as plastic, or the like. By way of example, the core 3 may be manufactured from a porous plastic such as polypropylene that has been treated (e.g., soaked for about 2 hours in or sprayed) with a disinfectant such as that commercially known as Lysol. The dimensions of the core vary with the dimensions of the handle with which the handle guard 1 will be associated. Ideally, however, the core will have an outside diameter of 0.75 to 1.75 inches and a length between 3 to 6 inches. A slit 5 runs longitudinally through one side of the core 3. The slit 5 is sized to permit a door handle to pass therethrough when the handle guard 1 is moved into surrounding engagement with the handle (to be described in greater detail hereinafter when referring to FIGS. 4 and 5).

To this end, it is preferable that the width of the longitudinal slit 5 through core 3 be less than the corresponding width of the handle. Thus, the receipt of the door handle within the slit 5 will cause the flexible core 3 to be momentarily bent and stressed. When the door handle passes completely through the slit 5 for receipt at the interior of the hollow core 3, the core will relax and snap into removable surrounding engagement with the handle.

Figure 2:
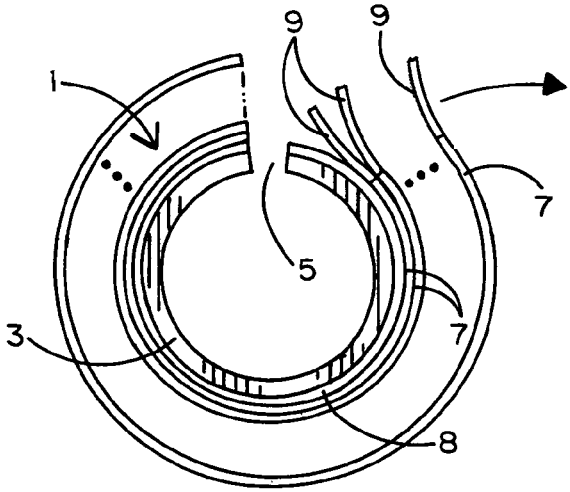
FIG. 2 shows a roll of peel-off protective strips wrapped around the hollow core of FIG. 1 to form the door handle guard.

Referring particularly to FIG. 2 of the drawings, there is shown a roll of disposable peel-off protective strips 7 lying one above the other and wrapped around the hollow cylindrical core 3 of the handle guard 1. The last or bottom strip of the roll is a backing 8 which is bonded to the core 3. Each strip 7 is sized to as to avoid covering the slit 5 through the core 3 and interfering with the attachment of the core 3 to the door handle. The length of successive ones of the strips 7 that are wrapped around the core 3 preferably increase from one strip to the next so as to be able to fully cover the strip which lies below. Each strip 7 is manufactured from a thin (e.g., 3 mils thick) flexible film such as polyethylene or any other suitable material. One end of each strip 7 lying adjacent the slit 5 through core 3 terminates at a pull tab 9. The pull tabs 9 can be manufactured from paper or plastic and must be strong enough to withstand a pulling force applied thereto when it is desirable to remove the top-most strip 7 from the roll for disposal following use.

FIG. 2 shows the pull tabs 9 extending laterally and completely across one end of each of the strips 7 such that the pull tabs 9 lie one above the other. However, it is within the scope of this invention for the pull tabs 9 to project outwardly from a corner of each of the strips 7 at which to receive a manual pulling force.

Figure 3:
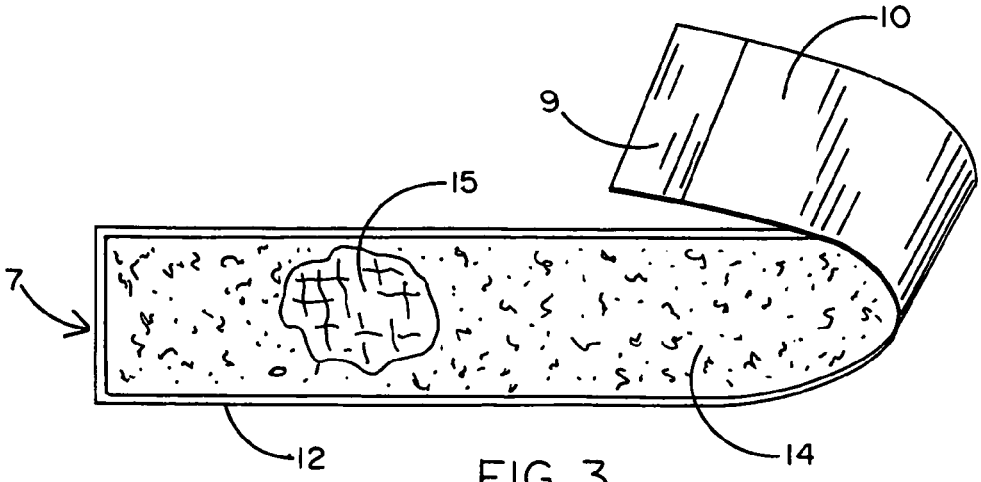
FIG. 3 shows the top and bottom surfaces of one of the peel-off protective strips from the roll of FIG. 2.

Turning now to FIG. 3 of the drawings, the top 10 of each peel-off protective strip 7 is dry (i.e., untreated), while the bottom 12 of strip 7 is treated with a tacky or sticky germ-resistant layer 14. That is, and as an important feature of this invention, the bottom 12 of each strip 7 is covered (e.g., coated) with a dual-function layer 14 containing a mixture of an adhesive and a microbicide 15.

By way of example only, a suitable non-toxic dry adhesive for the dual-function layer 14 at the bottom 12 of each strip 7 is that manufactured by Advanced Polymers International of Syracuse, N.Y. and known commercially as Gel-Tack 250D. An anti-microbial material that may be mixed into the adhesive prior to its application to the strips 7 is that manufactured by Rohm & Haas Corporation and known commercially as KATHON LX 1.5%. It should be understood that the particular adhesive and anti-microbial materials described above are for purposes of example and not intended to form limitations of this invention.

By way of further example, the tacky/sticky germ-resistant layer 14 is preferably a mixture (by weight) of 55% adhesive, 44% water, and 1% ammonia. The adhesive, prior to mixing, preferably contains 1.5% (by weight) anti-microbial material. The components of the germ-resistant layer 14 may be mixed together in a bucket or tub and spread over the bottom 12 of strips 7 by means of rollers.

Wide and long film sheets are initially covered with the aforementioned germ-resistant layer at one side (i.e., the bottom) thereof. Once the layer has dried, the sheets are cut into the individual protective strips 7 to be stacked above one another and rolled around the core 3.

When the protective strips 7 are stacked one above the other and rolled around the core 3 (of FIGS. 1 and 2), the dry untreated top 10 of each strip is initially germ free. The adhesive from the dual-function layer 14 will cause the bottom 12 of one strip from the roll of strips to be bonded to the germ-free top 10 of an adjacent strip lying immediately therebelow to seal and preserve its germ-free initial condition. At the same time, some of the adhesive from the bottom 12 of the strip above will be transferred by contact to the top of the adjacent strip located below. Inasmuch as the germ-resistant layer 14 along the bottom 12 contains a mixture of both adhesive and microbicide 15, some of the germ-preventing microbicide will also transfer to and be retained at the top of the adjacent strip lying underneath. In this same regard, the microbicide 15 will prevent the growth of bacteria within the adhesive layer 14 that might otherwise occur following long periods of storage or non-use.

Whenever the top-most strip 7 of the handle guard 1 is peeled off and removed from the roll of strips (by means of applying a pulling force to the pull tab 9 thereof), the outwardly facing top 10 of the next strip from the roll will be pretreated with a germ-inhibiting anti-microbial residue that was transferred from the layer 14 which covers the bottom of the strip just removed. Thus, the hand of one grasping the new top-most protective strip 7 from the handle guard 1 will encounter the microbicide which discourages the growth and spread of potentially disease-causing bacteria. The used strip just removed from handle guard 1 may now be discarded.

Figure 4:
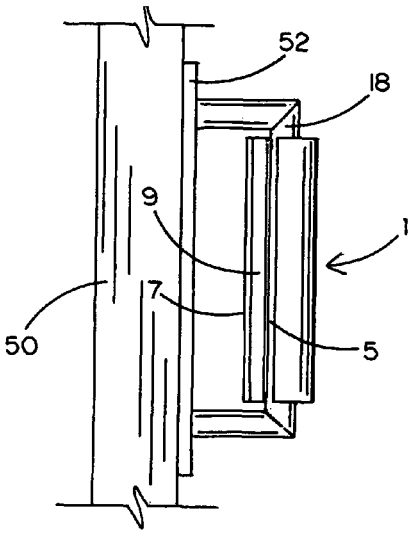
FIG. 4 shows the handle guard including the hollow core and roll of peel-off protective strips of FIG. 2 removably attached to a first door handle.
Figure 5:
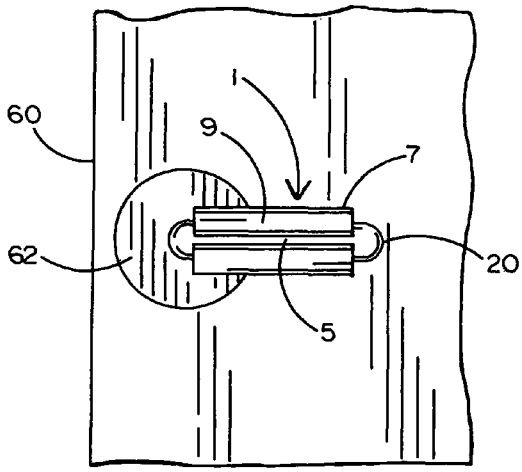
FIG. 5 shows the handle guard including the hollow core and the roll of peel-off protective strips of FIG. 2 removably attached to a different door handle.

FIGS. 4 and 5 of the drawings show examples of conventional door handles to which the handle guard 1 of this invention can be removably attached. In the example of FIG. 4, the door handle 18 is spaced from and extends vertically along the door 50. In the example of FIG. 5, the handle 20 is spaced from and extends horizontally along the door 60. The door handle 18 of FIG. 4 is fixedly attached to and stands outwardly from a door plate 52, and the door handle 20 of FIG. 5 runs through and is rotatable relative to a door cap 62. In each case, the door handles 18 and 20 are received inside the hollow cylindrical core 3 (of FIGS. 1 and 2) of handle guard 1 by having the handle move through the slit 5 in the core such that the handle 18 or 20 is surrounded by the core. Once all of the protective strips 7 have been used and pulled off the core 3, the handle guard is removed by pulling the core 3 off the handle 18 or 20 via the slit 5.

Although FIGS. 4 and 5 show the handle guard 1 lying in surrounding engagement with a door handle, it is to be understood that the handle guard may also be removably attached to other handles, such as those found in the home, business, public transportation, or any other location where frequent hand contact is expected and a germ-free environment is desirable.

FIGS. 6-9 of the drawings illustrate a disposable door guard 30 according to another preferred embodiment of this invention to prevent the spread of disease-causing bacteria among those whose hands touch and apply a pushing force to the door to cause the door to open. In the example of FIGS. 1-5, a pulling or pushing force is applied to a handle 18 or 20 to cause a door to open. In some cases, however, a door to be opened has no handle. Therefore, the pushing force is applied directly to a pushing surface of the door.

Figure 6:
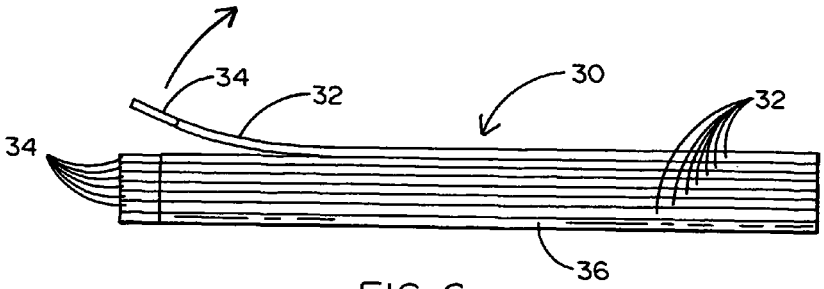
FIG. 6 shows a stack of peel-off protective strips from a disposable door guard according to a second preferred embodiment of this invention.

The door guard 30 of FIGS. 6-9 is especially applicable for creating a germ-reducing barrier to prevent direct contact between the hand of an individual and a door which has no handle to be pulled or pushed. As shown in FIG. 6, the door guard 30 includes a stack of rectangular peel-off protective strips 32. The strips 32 are ideally manufactured from a flexible (e.g., polyethylene) film having a thickness of 3 mils, a length of 16 inches, and a width of 4 inches. Paper or plastic pull tabs 34 extend laterally across one end of the strips 32 to which a pulling force is applied to peel the topmost strip off the stack. The last or bottom most strip from the stack is a backing 36 upon which the strips are laid one above the other.

Figure 7:
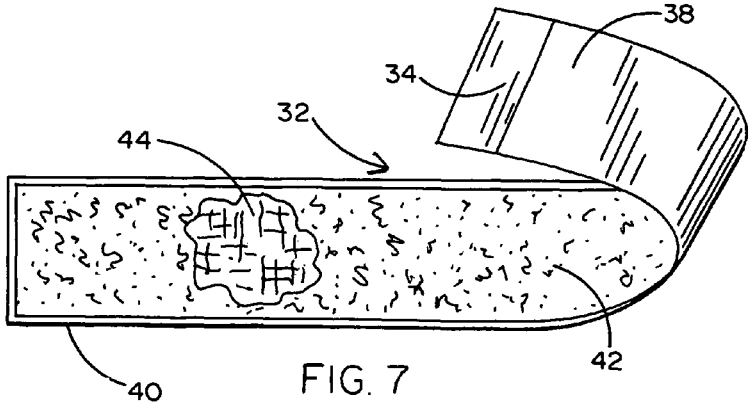
FIG. 7 shows the top and bottom surfaces of one of the peel-off protective strips from the stack of FIG. 6.

Referring particularly to FIG. 7, there is shown one strip 32 from the stack of strips of the door guard 30. Each strip 32 of the door guard 30 from the stack shown in FIG. 6 is preferably identical to the strip 7 of the handle guard 1 from the roll shown in FIG. 2. Therefore, only a brief description of strip 32 will be provided.

The top 38 of each peel-off protective strip 32 is a dry and untreated, while the bottom of strip 32 is covered (e.g., coated) with a dual-function tacky or sticky germ-resistant layer 42 that contains a mixture of adhesive and microbicide 44 such as those listed in the examples described above. As earlier disclosed, an anti-microbial material is added to the adhesive prior to the application of the tacky/sticky germ-resistant layer 42 to the bottom 40 of strip 32. The germ-resistant layer may be spread (i.e., rolled) while wet over the bottom of relatively wide and long film sheets. Once the layer has dried, the sheets are cut to size to create the individual protective strips 32 shown in FIGS. 6 and 7 to be arranged in a stack.

When the protective strips 32 are laid one above the other to form the stack for the door guard 30 of FIG. 6, the dry, untreated top 38 of each strip is initially germ free. The adhesive from the dual-function layer 42 will cause the bottom 40 of one strip of the stack of strips to be bonded to the germ-free top 38 of an adjacent strip lying immediately below to seal and preserve its germ-free initial condition. At the same time, some of the adhesive from the bottom 40 of the strip above will be transferred by contact to the top of the adjacent strip located below. Inasmuch as the germ-resistant layer 42 along the bottom 40 contains both adhesive and microbicide 44, some of the germ-preventing microbicide will also be transferred to and retained at the top of the adjacent strip lying underneath. In this same regard, the microbicide 44 will prevent the growth of bacteria within the adhesive of layer 42 that might otherwise occur following long periods of storage or non-use.

Figure 8:
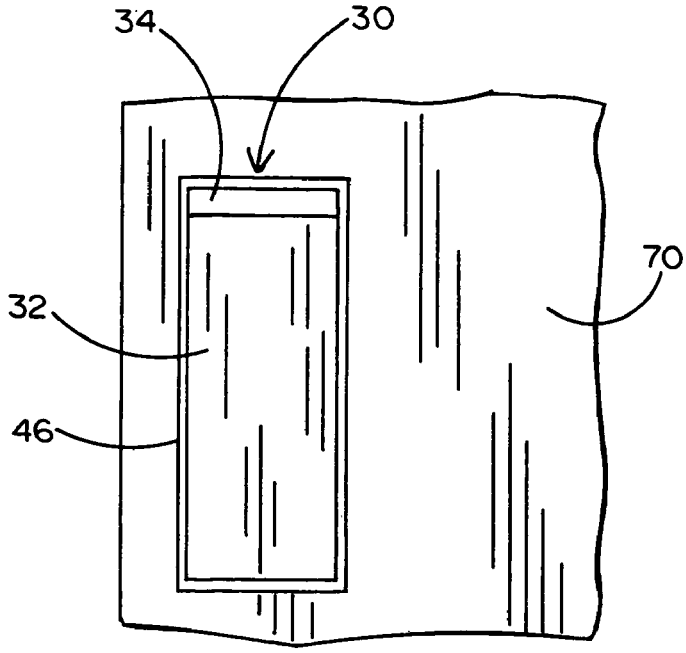
FIG. 8 shows the door guard including the stack of peel-off protective strips of FIG. 6 covering a push plate mounted on a door.
Figure 9:
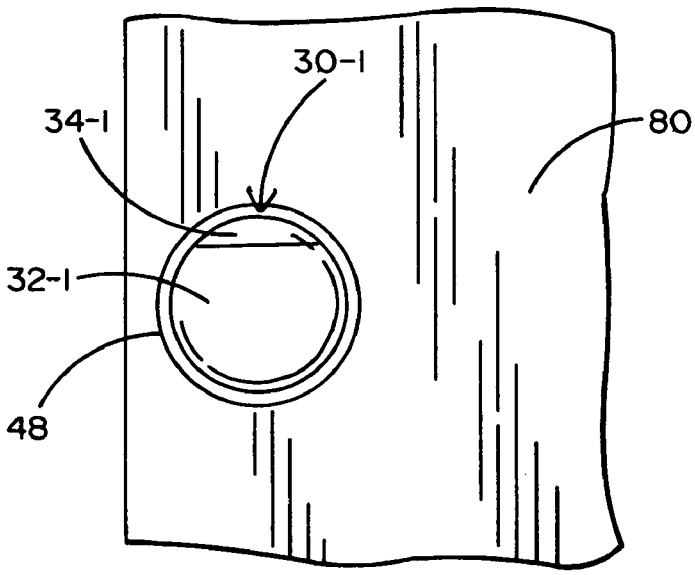
FIG. 9 shows a modified door guard including a stack of peel-off protective strips covering a push button that is depressed for causing a door to open.

FIGS. 8 and 9 of the drawings show doors 70 and 80 having touch-contact surfaces to which a pushing force is manually applied to cause the doors to open. In the case of the door 70 of FIG. 8, the touch-contact surface thereof is shown as a vertical rectangular plate 46 affixed to the door. However, the touch-contact surface may also be a horizontal plate (not shown) or no plate at all. The stack of peel-off protective strips 32 from the door guard 30 is adhesively bonded to the door plate 46 or directly to the door if no plate is present. Accordingly, the hand of an individual exerting a pushing force against the door plate 46 will engage the door guard 30 and encounter the microbicide which has been transferred to the topmost strip thereof.

The topmost strip 32 of the door guard 30 may be peeled off and removed from the stack on an as-desired basis following use or at pre-determined time intervals. Whenever the topmost strip 32 is removed (by means of applying a pulling force to the pull tab 34 thereof), the outwardly facing top 38 (of FIG. 7) from the next strip which has been pre-treated with germ-inhibiting residue will be exposed in order to discourage the growth and spread of potentially disease-causing bacteria. The used strip just removed from the door guard 30 may now be discarded.

In the case of the door 80 of FIG. 9, the touch-contact surface to which a pushing force is manually applied is a round push button 48. Such a push button 48 is commonly found in a hospital or similar healthcare facility to cause a door to be opened automatically on contact. Rather than a stack of rectangular peel-off protective strips 32 as has been heretofore described, the door guard 30-1 of FIG. 9 is shown having a stack of peel-off protective disk-like covers 32-1 which conform in shape and size to the round push button 48. A pull tab 34-1 is located at one side of each cover 32-1 to enable the topmost cover to be removed and discarded following use. The covers 32-1 of door guard 30-1 are treated with a dual-function adhesive/anti-microbial layer (not shown) along the bottom in the same manner as earlier disclosed when describing the layer 42 that is applied to the bottom 40 of each of the peel-off strips 32 from the door guard 30 of FIGS. 6 and 7. Thus, it should be appreciated that the advantages of this invention are not limited to requiring that the protective strips and covers 32 and 32-1 from the door guards 30 and 30-1 of FIGS. 8 and 9 have any particular size and/or shape.

The peel-off protective strips 7 from the handle guard 1 of FIGS. 1-5, the peel-off protective strips 32 from the door guard 30 of FIG. 8, and the peel-off protective covers 32-1 from the door guard 30-1 of FIG. 9 have all been described as having a dry, untreated germ-free top and an adhesive/anti-microbial layer (14 and 42) applied over the bottom. However, it is to be understood that the bottom may be otherwise dry and the top treated with the aforementioned adhesive/anti-microbial layer. By virtue of the foregoing, the individual's hand will encounter a sticky/tacky feel on contact with the top surface which is characteristic of the adhesive into which the microbicide is mixed to form the layers 14 and 42. A reduction in the sticky/tacky feel may indicate that the outermost strip/cover from the stack has been used and is in need of removal and replacement.

The invention claimed is:

1. A door guard to prevent direct touch contact between an individual's hand and a contact surface of a door to which a pushing force is manually applied to cause the door to open, said door guard comprising a plurality of protective coverings lying one above the other in a stack to be retained over said contact surface to establish a germ-free barrier between the individual's hand and said contact surface, successive ones of said plurality of protective coverings being removable from said stack, each of said plurality of protective coverings having a top surface and a bottom surface, the bottom surfaces of said plurality of protective coverings having a layer of adhesive applied thereto by which said plurality of protective coverings are adhesively and detachably bonded to one another to form said stack, and wherein there is a microbicide included with said layer of adhesive, the top surfaces of said plurality of protective coverings from said stack being germ free by means of the contact between the bottom surfaces of said protective coverings containing said mixture of adhesive and microbicide and respective adjacent top surfaces of said protective coverings, such that when a first of said plurality of protective coverings is removed from the stack, the top surface of the next protective covering lying directly below the first protective covering will be germ free so as to establish said germ-free barrier between the individual's hand and the contact surface over which said plurality of protective coverings are retained.

2. The door guard recited in claim 1 wherein each of said plurality of protective covering has a pull tab at one end thereof to which a pulling force is applied to enable respective ones of said coverings to be detached from said stack.

3. The door guard recited in claim 1, wherein the contact surface of the door to which the pushing force is applied to cause the door to oven is a plate attached to the door, and wherein each of said plurality of protective coverings which lie above one another to be retained over said plate is a rectangular strip.

4. The door guard recited in claim 1, wherein the contact surface of the door to which the pushing force is applied to cause the door to open is a push button, and wherein each of said plurality of protective coverings which he above one another to be retained over said push button is a round disk.

5. The door guard recited in claim 1 wherein the contact surface of the door to which the pushing force is applied to cause the door to open is a handle, said door guard also comprising a hollow core located in surrounding engagement with the door handle, and wherein each of said plurality of protective coverings which he above one another extend around said core.

6. A guard to prevent direct touch contact between an individual's hand and a contact surface towards which the individual's hand is moved, said guard comprising a plurality of protective coverings laid one above the other and adapted to be positioned over and attached to the contact surface to establish a germ-free barrier between the individual's hand and the contact surface, wherein each of said plurality of protective coverings has a top surface and a bottom surface, the bottom surfaces of said plurality of protective coverings having a layer containing an adhesive applied thereto by which said plurality of protective coverings are adhesively bonded to one another, and wherein there is a microbicide added to said adhesive prior to the application of said layer to the bottom surfaces of said plurality of protective coverings, so that said layer includes a mixture of adhesive and microbicide, the top surfaces of said plurality of protective coverings being germ free by means of the contact between the bottom surfaces of said protective coverings containing said mixture of adhesive and microbicide and respective adjacent top surfaces of said protective coverings, such that when a first of said plurality of protective coverings is removed, the top surface of the next protective covering lying directly below the first protective covering will be germ free so as to establish said germ-free barrier between the individual's hand and the contact surface to which said plurality of protective covering are attached.

* * * * *